United States Patent [19]

Vella

[11] 4,265,452

[45] May 5, 1981

[54] GOLF CLUB

[75] Inventor: Tony J. Vella, 3504 Wesleyan Ave., Rockford, Ill. 61108

[73] Assignee: Tony J. Vella, Rockford, Ill.

[21] Appl. No.: 55,265

[22] Filed: Jul. 6, 1979

[51] Int. Cl.[3] ..... A63B 53/02

[52] U.S. Cl. ..... 273/167 G

[58] Field of Search ..... 273/77 R, 78, 80 C, 273/80.2, 163 R, 164, 167–175, 81.3; D21/214–220

[56] References Cited

U.S. PATENT DOCUMENTS

| | | | |
|---|---|---|---|
| D. 150,798 | 8/1948 | Liolich | D21/217 |
| D. 191,211 | 8/1961 | Forest | D21/219 |
| D. 240,366 | 6/1976 | Cook | 273/167 G X |
| D. 240,445 | 7/1976 | Becker | 273/167 G X |
| 1,652,404 | 12/1927 | Graveure | 273/164 |
| 3,448,981 | 6/1969 | Anweiler | 273/167 G X |
| 3,762,717 | 10/1973 | Johnston | 273/167 G X |
| 4,163,554 | 8/1979 | Bernhardt | 273/167 G X |

FOREIGN PATENT DOCUMENTS

| | | | |
|---|---|---|---|
| 558183 | 1/1975 | Switzerland | 273/80 C |
| 1232651 | 5/1971 | United Kingdom | 273/80 C |

*Primary Examiner*—Richard J. Apley

*Attorney, Agent, or Firm*—Mason, Kolehmainen, Rathburn & Wyss

[57] ABSTRACT

A golf club has an offset shank between its shaft and its head. The offset shank has an arcuate reinforcing rib interconnecting intermediate and lower legs of the shank and extending to the head. This prevents the various legs of the shank from bending. The shaft is inclined rearwardly at a small angle to position the handle or grip above the head while the shaft is aligned with a golf ball when at rest.

10 Claims, 6 Drawing Figures

14
10
12
13
13'
20
16
X
Y
50
B
42
44
46
52
36
37
24
28
47
22
26
32
35
34

GOLF CLUB

BACKGROUND

The invention pertains generally to the art of games and more particularly to the game of golf.

Applicant's U.S. Pat. No. 3,909,004, issued Sept. 30, 1975, shows a golf putter with a head shaped somewhat like the head disclosed herein. The hosel for the shaft, however, is located rearwardly of the striking face. Others have provided an offset shank which locates the hosel in front of the striking face. For example, see U.S. Pat. No. 3,077,350 issued Feb. 12, 1963, to H. Koorland; and U.S. Pat. No. 3,448,981 issued June 10, 1969, to D. M. Anweiler. Usually the offset shank and the putter head are cast integrally of a metal that is ductile. This ductility can allow the offset shank to bend slightly when the putter is leaned on or if there is some weight on it when lying flat as in the trunk of a car. Any such bend will change the putting characteristics of the club. Accordingly it is desirable to provide a golf club with an offset shank which will not bend.

In a standard golf club, the shaft is aligned with the head. In a golf club having an offset shank, the shaft is aligned with the ball when at rest. Certain advantages are attributed to each arrangement. It is desirable to provide a golf club with the advantages of both arrangements.

SUMMARY

The present invention relates to a golf club, and more particularly to a golf club having an offset shank. The invention is directed to providing a golf club having one or more of the desirable features mentioned above.

In accordance with one feature of the present invention there is provided a golf club having a head; an offset shank; and a reinforcing rib interconnecting lower and intermediate legs of the offset shank and extending substantially the entire length of each of said legs, and the outer extremity of the rib defining a concave, arcuate edge, the lower end of which is contiguous with the frontal striking surface of the head.

According to another feature of the present invention there is provided a golf club having a head; an offset shank; a shaft connected to the offset shank and inclined toward the heel portion of the head and also inclined at a small angle toward the lower leg of the offset shank so that the center of the grip on the shaft is substantially in line with the lower leg.

Advantageously the small angle is less than 5°, and preferably about 1° 40′.

These, and other features and advantages of the present invention, will become apparent as the same becomes better understood from the following detailed description when taken in conjunction with the accompanying drawings.

DRAWING

DESCRIPTION

Figures 1, 2, 3, 4, 5, 6:
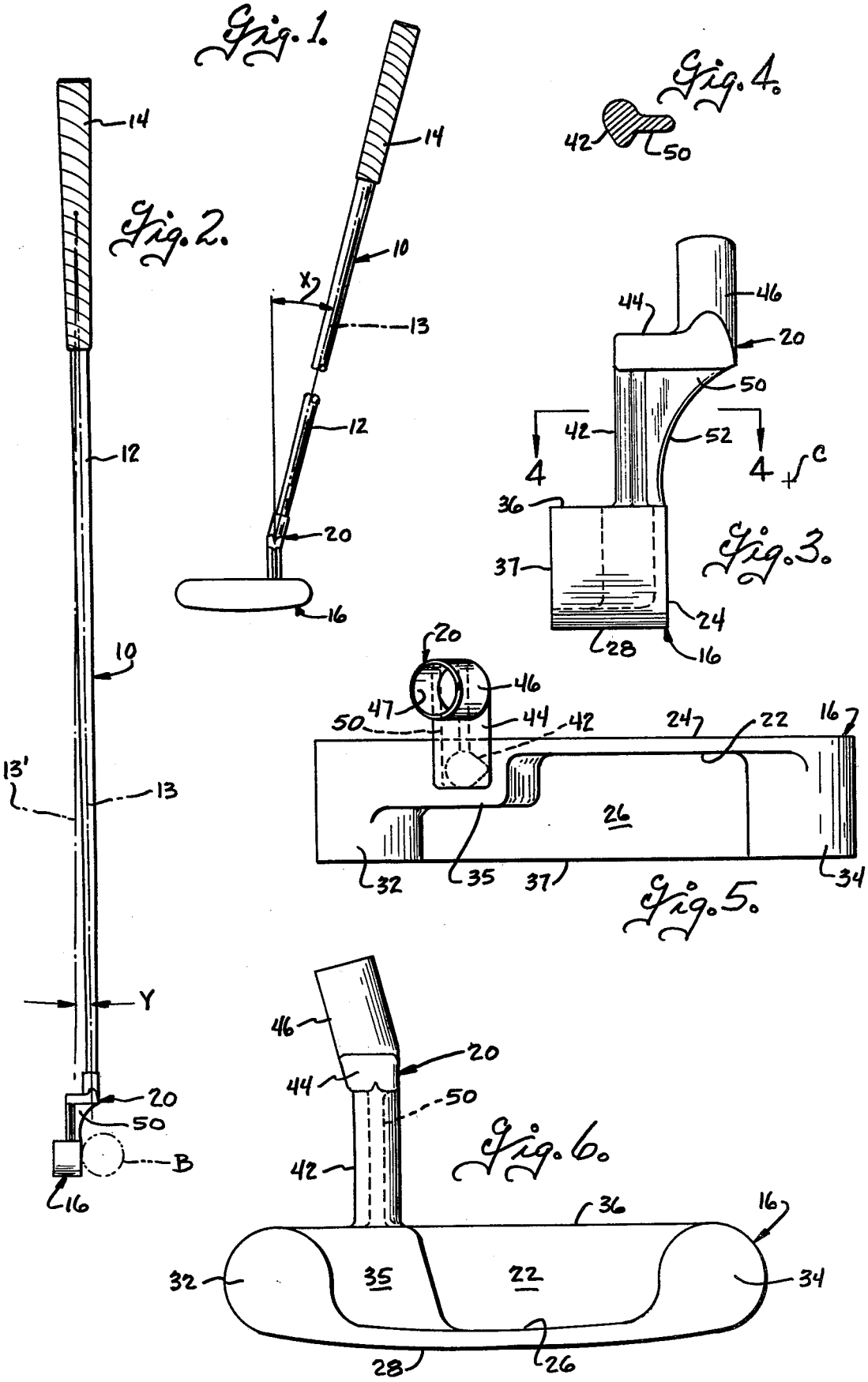
FIG. 1 is a front elevation of a putter and having a portion of the shaft broken away.
FIG. 2 is an end elevation as seen from the left in FIG. 1.
FIG. 3 is an end elevation, similar to FIG. 2, showing the head and offset shank in full scale.
FIG. 4 is a cross-section taken generally along line 4—4 of FIG. 3.
FIG. 5 is a full-scale top view of the head and offset shank.
FIG. 6 is a full-scale rear view thereof.

Reference is now made more particularly to the drawings which illustrate the best known mode of carrying out the invention and wherein similar reference characters indicate the same parts throughout the several views.

A golf club, advantageously in the form of a putter 10, includes a shaft 12 having a longitudinal axis 13 with a handle 14 at one end and a putter head 16 at the other end. An offset shank, generally designated 20, is integral with the head 16 and is connected to the shaft 12. While other materials may be used, the head and offset shank are advantageously a silicon bronze casting. The preferred formulation of the silicon bronze is 83% copper, 10% zinc, 5% silicon, 0.5% iron, 0.5% phosphorus, 0.5% aluminum, and the remainder trace elements. Silicon bronze is an alpha solid solution alloy and is ductile.

The putter head 16 is similar to that shown in the above-mentioned U.S. Pat. No. 3,909,004. Briefly, it has a thin front wall 22 which defines a frontal striking surface 24. As seen in FIG. 2, the striking surface 24 has a heigth greater than the radius of a golf ball B, but less than the diameter thereof. A bottom wall 26 has an arcuate lower surface 28. First and second cylindrical members 32, 34 are provided at the heel and toe, respectively, of the head. A mounting block 35 is adjacent member 32. The head has a flat top surface 36 defined by wall 22 and block 35, as best seen in FIG. 6. A rear surface 37 is defined by wall 26 and members 32, 34, as best seen in FIG. 5.

Offset shank 20 includes a lower leg 42, an intermediate leg 44, and an upper or outer leg 46. The lower leg 42 has a tear-drop cross section (see FIG. 4) and is connected to the top surface 36 of the head by virtue of the integral casting. The lower leg 42 extends perpendicular from said top surface 36 at a location one-quarter of the distance from the heel to the toe.

The intermediate leg 44 has a trapazoidal cross section (see FIG. 6) and extends forwardly from and perpendicular to the upper end of the lower leg. Thus the intermediate leg lies in a plane parallel to the top surface 36. It is also generally perpendicular to the striking surface plane in the present embodiment; however, this relationship will change if the striking surface is inclined as in a typical iron. As seen in FIGS. 2 and 4, the intermediate leg 44 extends forward of the striking surface 24 at least a fraction of the radius of the golf ball B, and may extend forward far enough that the shaft axis 13 would intersect the center of the ball when in the position of FIG. 2.

The outer leg 46 is cylindrical in shape. It extends upwardly from the outer end of the intermediate leg 42 and is inclined toward the heel at an acute angle X from a plane defined by the other two legs. Angle X is advantageously 15° in the embodiment illustrated. While other arrangements are possible, the outer leg 46 has a hosel 47 into which the shaft 12 is received and secured. As seen in FIGS. 1 and 2, the shaft and the outer leg are coextensive and are inclined at an obtuse angle of 105° to the top surface 36. The shaft and outer leg are also inclined at a small angle toward the lower leg 42 so that the center of the grip 14 is substantially in line with the lower leg. This angle is identical to an angle Y between axis 13 and a line 13′ extending from the center of the grip 14 to the lower leg 42. Preferably this small angle Y is less than 5° and, in the embodiment shown, is 1° 40′. This arrangement provided by angle Y provides a visual aim or sight along the shaft 12 at the ball B, yet keeps the grip 14 and hence the hands of a golfer aligned with the club head 16.

As best seen in FIG. 3, a reinforcing rib 50 interconnects lower leg 42 and intermediate leg 44 and extends the entire length of each. The rib has an outer extremity which defines a concave arcuate edge 52. The lower end of edge 52 is contiguous with the frontal striking surface 24, but extends rearwardly of surface 24 for a short distance. This distance is at least equal to the difference between the diameter of the golf ball B and the heigth of the striking surface 24. Preferably edge 52 is a segment of a circle having a radius generally equal to the distance from the top surface 36 to the underside of intermediate leg 44, and having a center C at a level above the top surface 36 (see FIG. 3). Thus the lower portion of the edge 52 is disposed rearwardly of the striking surface 24.

It is now deemed apparent that there has been disclosed a golf club with an offset shank which will not bend and thus will maintain the striking surface positioned relative to the shaft. The golf club has its grip in line with the head while the shaft is aligned with the ball when at rest. Thus the present embodiment has the advantages of both the standard club and the type club having an offset shank.

While the preferred embodiment of a golf club has been herein illustrated and described as a putter, it is contemplated that the principles may be applied to other golf clubs, especially iron. Accordingly, the invention should not be limited except as required by the scope of the appended claims.

The embodiments of the invention in which an exclusive property or privilege is claimed are defined as follows:

1. A golf club comprising:

a head having a frontal striking surface, a top surface, a bottom surface, a rear surface, and toe and heel portions;

an offset shank including a lower leg, an intermediate leg and an outer leg; the lower leg being connected to the top surface of the head and extending perpendicularly therefrom; the intermediate leg extending forwardly of the striking surface a distance which is at least a fraction of the radius of a golf ball; the outer leg extending upwardly from the outer end of the intermediate leg and inclined toward the heel portion at an acute angle from a plane defined by the other two legs;

a reinforcing rib interconnecting the lower and intermediate legs and extending substantially the entire length of each of said legs; and the outer extremity of the rib defining a concave, arcuate edge, the lower end of which is contiguous with the frontal striking surface;

an elongate shaft generally coextensive with said outer leg and having one end connected to the outer leg and a grip at its other end; and said outer leg and said elongate shaft being arranged at an angle slightly less than 90° to the intermediate leg so that the center of the grip is substantially in line with the lower leg.

2. A golf club according to claim 1 wherein the head is a putter head; the lower leg is connected to the top surface of the putter head at about one-quarter of the distance from the heel portion to the toe portion; the striking surface has a heigth which is greater than the radius of a golf ball, but less than the diameter thereof; and the lower portion of the arcuate edge of the rib extends rearwardly of the striking surface at least a distance equal to the difference between the diameter of the golf ball and the heigth of the striking surface.

3. A golf club according to claim 2 wherein the arcuate edge is a segment of a circle having a radius generally equal to the distance from the top surface of the head to the underside of the intermediate leg, and a center at a level above the top surface to thereby dispose the lower portion of the arcuate edge rearwardly of the striking surface.

4. A golf club comprising:

a head having a frontal striking surface, a top, a bottom, a rear, and toe and heel portions;

an offset shank including a lower leg, an intermediate leg and an outer leg; the lower leg being connected to the top of the head and extending upwardly therefrom; the intermediate leg extending forwardly from the upper end of the lower leg and forwardly of the striking surface a distance which approaches the radius of a golf ball; the outer leg extending upwardly from the outer end of the intermediate leg;

an elongate shaft having one end connected to the outer leg and having a grip at its other end;

the shaft and outer leg being coextensive and inclined toward the heel portion at an obtuse angle to the top of the head and also inclined at a small angle toward the lower leg so that the center of the grip is substantially in line with the lower leg; and rib means interconnecting the lower and intermediate legs for reinforcing the same extending normal to said striking surface and forwardly thereof.

5. A golf club according to claim 4 wherein said small angle is less than 5°.

6. A golf club according to claim 4 wherein the head is a putter head, the intermediate leg extends forwardly of the striking surface a distance less than the radius of a golf ball, and said small angle is less than 20°.

7. A golf club comprising:

a head having a frontal striking surface, a top surface, a bottom surface, a rear surface, and toe and heel portions;

an offset shank including a lower leg, an intermediate leg and an outer leg; the lower leg being connected to the top surface of the head and extending upwardly therefrom; the intermediate leg extending forwardly from the upper end of the lower leg and forwardly of the striking surface a distance which approaches the radius of a golf ball; the outer leg extending upwardly from the outer end of the intermediate leg;

a reinforcing rib interconnecting the lower and intermediate legs and extending substantially the entire length of each of said legs;

an elongate shaft having one end connected to the outer leg and having a grip at its other end; and the shaft and outer leg being coextensive and inclined toward the heel portion at an obtuse angle to the top surface and also inclined at a small angle toward the rear surface so that the center of the grip is substantially in line with the lower leg.

8. A golf club according to claim 7 wherein the head is a putter head, the intermediate leg extends forwardly of the striking surface a distance less than the radius of a golf ball, and said small angle is about 1° 40′.

9. A golf club according to claim 8 wherein the lower leg is connected to the top surface at about one-quarter of the distance from the heel portion to the toe portion and extends perpendicularly from the top surface; the intermediate leg is perpendicular to the lower leg; the striking surface has a heigth which is greater than the radius of a golf ball, but less than the diameter thereof; and the lower portion of the reinforcing rib is disposed rearwardly of the striking surface at least a distance equal to the difference between the diameter of the golf ball and the heigth of the striking surface.

10. A golf club according to claim 9 wherein the head, offset shank and reinforcing rib are formed in a unitary casting of silicon bronze; and the outer extremity of the rib defines a concave, arcuate edge comprising a segment of a circle having a radius generally equal to the distance from the top surface of the head to the underside of the intermediate leg, and a center at a level above the top surface to thereby dispose the lower portion of the arcuate edge rearwardly of the striking surface.

* * * * *